US007578007B2

(12) United States Patent
McIntyre

(10) Patent No.: US 7,578,007 B2
(45) Date of Patent: Aug. 25, 2009

(54) DOUBLE HINGED/DOUBLE SPRING ACTION HAT CLIP

(75) Inventor: William Charles McIntyre, 1613 Emerald St., Broomfield, CO (US) 80020

(73) Assignee: William Charles McIntyre, Broomfield, CO (US)

( * ) Notice: Subject to any disclaimer, the term of this patent is extended or adjusted under 35 U.S.C. 154(b) by 0 days.

(21) Appl. No.: 11/405,713

(22) Filed: Apr. 18, 2006

(65) Prior Publication Data

US 2007/0240287 A1 Oct. 18, 2007

(51) Int. Cl.
*A42B 1/06* (2006.01)

(52) U.S. Cl. ..... 2/181.4; 2/174; 24/331; 24/485; 24/510

(58) Field of Classification Search ..... 24/3.1, 24/3.11, 3.12, 510; 2/175.6
See application file for complete search history.

(56) References Cited

U.S. PATENT DOCUMENTS

| | | | | | |
|---|---|---|---|---|---|
| 206,388 | A | * | 7/1878 | Brown | 24/510 |
| 245,103 | A | * | 8/1881 | Vickars | 24/485 |
| 787,899 | A | * | 4/1905 | Curry | 24/332 |
| 1,373,619 | A | * | 4/1921 | Kohn | 24/331 |
| 5,081,717 | A | * | 1/1992 | Shedd et al. | 2/181.4 |
| 6,163,886 | A | * | 12/2000 | Carter | 2/172 |

* cited by examiner

*Primary Examiner*—Jack W. Lavinder

(57) ABSTRACT

This double hinged/double spring loaded hat clip enables the wearer of a hat, to attach (and detach) with minimal effort or inconvenience, via the hat clips, a cloth or other type protective material for the purpose of providing additional protection from the weather elements, including, but not limited to, the sun, wind, rain, or cold.

14 Claims, 2 Drawing Sheets

PERSPECTIVE VIEW

SIDE VIEW

FRONT VIEW

- REPLACEMENT SHEET

POTENTIAL APPLICATIONS OF DOUBLE HINGED / SPRING ACTION, HAT CLIP

DOUBLE HINGED/DOUBLE SPRING ACTION HAT CLIP

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

This invention pertains to the apparel industry for the specific purpose of attaching a Bandana or other cloth type material to a hat for the purpose of providing protection from the sun or an adverse weather condition. The application of this invention will provide shade to the wearer during hot weather conditions or additional protection from the cold in cold-windy conditions. This application will also prevent injurious sun burn to the back of the neck area and sides of the face, if applied properly. During rain weather conditions, this application will assist in maintaining a dry head for the hat wearer should the bandana be made from a rain repellant material.

BRIEF SUMMARY OF THE INVENTION

This invention allows the attachment AND detachment of a bandana type material to a hat, for the purpose of providing shade from the sun, protection from the rain and/or wind. The advantage of this hat clip is that a permanent bandana does not need to be sewn into the baseball style hat or construction hard hat or cowboy style hat. The typical baseball style hat has, until this invention, no portable mechanism of attaching a bandana type shade/rain/wind protection. This invention provides for such a detachable mechanism that provides continuous, overlapping coverage with no gap. For ease of use, a ⅛-inch diameter synthetic rope can connect, but not required, the three clips. It is anticipated that 3 clips will be required for each style of hat. The clip system can remain attached to the hat, whether the bandana type cloth or other material is attached or not. The wearer, for example, can either custom cut the typical 19-inch by 19-inch bandana cloth to fit the wearer's shoulders, or leave the bandana as a square piece of cloth.

NOTE: This attaching of a bandana type material to a hat is similar to the "French Foreign Legion" type of headwear, HOWEVER, as a result of the double-hinged/double spring action hat clip, the bandana material is PORTABLE and can be ATTACHED or DETACHED at the desire of the hat wearer. In cold environments, a fleece material bandana can be used to provide for additional warmth and protection from the elements to the hat wearer.

BRIEF DESCRIPTION OF THE SEVERAL VIEWS OF THE DRAWING

FIG. 3 shows the width of the hat clip. The material that could be used for the hat clip, but are not limited to, include metal or plastic.

DETAILED DESCRIPTION OF THE INVENTION

Figure 1:
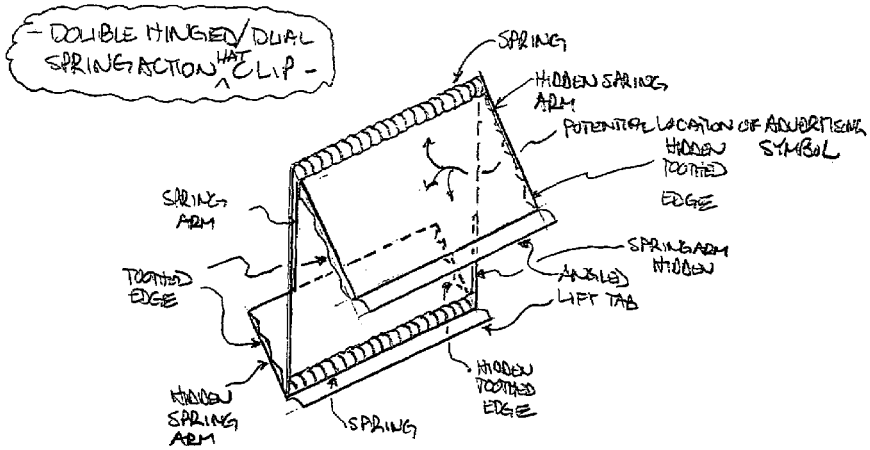
FIG. 1 shows a perspective view of the hat clip. The drawing shows how the two pre-tensioned springs, and associated tabs, located on a common plane (but opposite sides) will create compression upon any material between the toothed edge and the compression plate of the hat clip. Both moveable portions of the hat clip have an angled lift tab to ease separating the tooth edged flaps from the compression plate of the hat clip. The surface of the exposed lift tab can be used for advertising symbol for example. As a result of the 2 opposite edge located lift tabs, there is no gap between the bottom edge of the hat and the top edge of the protective material, i.e., the materials overlap.
Figure 2:
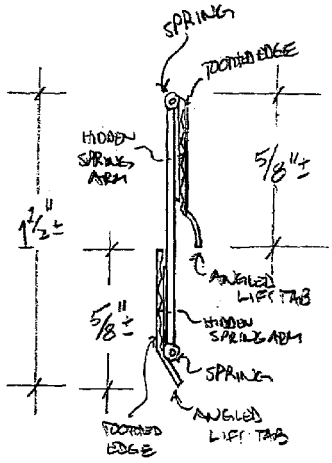
FIG. 2 & 3 depicts both a side view and a front view. The side view show approximate dimensions of the hat clip.
Figure 3:
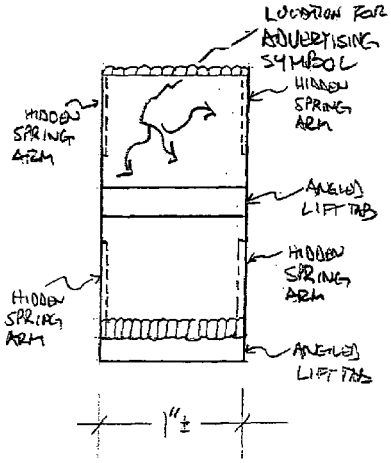
Figure 4:
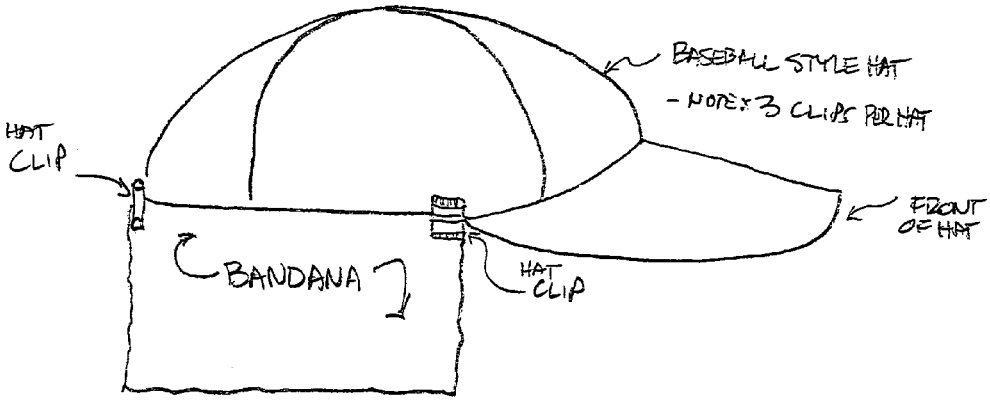
FIGS. 4, 5, & 6 show potential applications of the hat clip.
Figure 5:
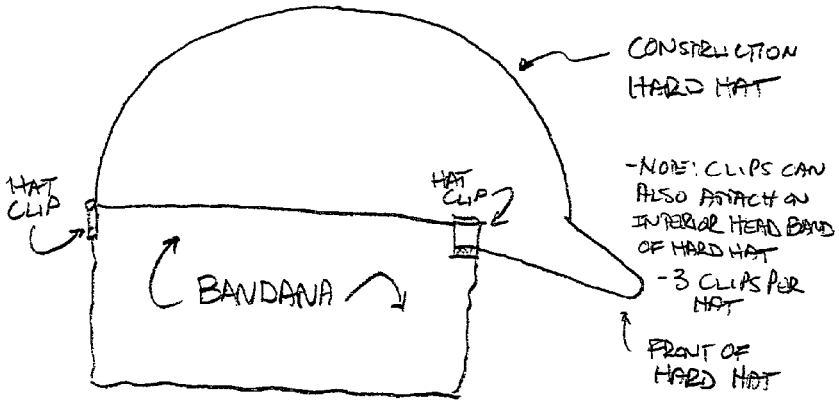
Figure 6:
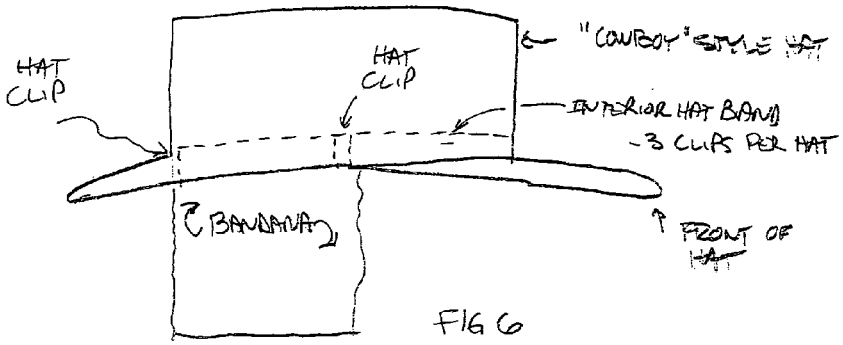

This hat clip can be manufactured using either a plastic or metal alloy material. The two pre-tensioned springs shall be manufactured using a metal material. The toothed edges shall be manufactured into the 2—lift tab pieces. The 2—lift tab pieces can be designed to snuggly fit various hat edge thicknesses. Also, the lift tab attached to the bottom inside hat edge, shall be flat, so as to result with no discomfort to the hat wearer. Also, the tab edging for the tab piece situated on the inside of the hat, shall be constructed to not tangle with the hat wearers hair.

The hat tabs can be connected by ⅛-inch or smaller diameter rope so that the hat wearer can detach the hat clips from the hat edge for storage until further use, making them less likely to be displaced.

The surface of the exposed lift tab can be a surface dedicated for the placement of an advertising symbol. This hat clip will solve the need of affixing a cloth type sun protector, rain protector, or wind protector, to the bottom edge of a hat, with no portion of the head being exposed along the perimeter of the hat between the hat clips on each side of the headdress.

The figures show the possible placement and operating extent of the double hinged/double spring action hat clips. The drawings of the baseball, construction hardhat, and cowboy style hats depict possible applications of the hat clip.

My double hinged/double spring action hat clip is sufficiently distinguishable and a non-obvious improvement from Vickars Clothes-Pin (U.S. Pat. No. 245,103, August, 1881) for the following reasons:

1. Vickars clothes-pin has a gap of at least length "A" between the 2 clips. This gap would negate the direct benefit of my hat clip, i.e., protection of the head from the elements, beneath the level of the bottom of a hat.
2. My hat clip is comprised of a common pressure plate. Vickars clothes-pin contains no common pressure plate.
3. My hat clip is designed with a flat tab for inside the hat edge. This is specifically designed to provide comfort to the hat wearer. As designed by Vickar, either of his clips could not be attached to the bottom edge of a hat (such as a baseball hat) without causing excess discomfort to the point of non-use.

My double hinged/double spring action hat clip is sufficiently distinguishable and a non-obvious improvement from Curry's Veil—Pin (U.S. Pat. No. 787,899 of April, 1905) for the following reasons:

1. Curry's Veil—Pin has a gap between the two fastening clasps, which negates the protection of the head from the elements to the exposed portion of the head. My hat clip has no such gap.
2. Curry's Veil—Pin, as currently designed, could not be affixed to the bottom edge of a baseball style hat, or a cowboy style hat (with a leather or cloth ring liner), without resulting in discomfort to the point of being problematic.

What is claimed is:

1. In combination:

A hat, having a generally annular body with an opening defined by a peripheral edge portion;

A generally planar shield having a peripheral edge portion; and

A clip member, comprising:

An engagement plate, having (i) opposite end portions; (ii) a first surface positioned to face a first direction; and (iii) a second surface positioned to face in a second direction that generally opposite the first direction;

A first clip arm, pivotably coupled with one end portion of said engagement plate so that the first clip arm may be selectively moved between a closed position, whereby a free end portion of said first clip arm is positioned closely adjacent the first surface of said engagement plate, and an open position, whereby the free end portion of said first clip arm is positioned in a spaced-apart relationship with the first surface of said engagement plate;

A second clip arm, pivotably coupled with one end of portion of said engagement plate so that the second clip arm may be selectively moved between a closed position, whereby a free end portion of said second clip arm is positioned closely adjacent the second surface of said engagement plate, and an open position, whereby the free end portion of said second clip arm is positioned in a space-apart relationship with the second surface of said engagement plate;

a portion of the peripheral edge portion of said shield being secured between the first clip arm and the first surface of the engagement plate of said clip member;

a portion of the peripheral edge portion of said hat being between the second clip arm and the second surface of the engagement plate of said clip member;

resulting in an overlap of the shield and hat, with the top edge of the shield being situated higher than the lower edge of the hat, whereby no gap is remaining between those two edge surfaces.

2. The combination of claim 1 further comprising:

a first spring operatively coupled with the first clip arm and the engagement plate whereby the first clip arm is urged toward said closed position; and a second spring operatively coupled with the second clip arm and the engagement plate whereby the second clip arm is urged toward said closed position.

3. The combination of claim 1 further comprising:

a first lift tab extending outwardly from the free end of said first clip arm; at least a portion of said first lift tab being disposed at an angle with respect to said first clip arm.

4. The combination of claim 1 further comprising:

a second lift tab extending outwardly from the free end of said second clip arm; at least a portion of said second lift tab being disposed at an angle with respect to said second clip arm.

5. The combination of claim 1 wherein:

said shield is comprised of a generally flexible material.

6. The combination of claim 1 wherein:

said shield is comprised of a generally flexible fabric.

7. The combination of claim 1 wherein:

said shield is positioned so that a length of said shield depends from at least one side portion of said hat.

8. The combination of claim 1 wherein:

said shield is positioned so that a length of said shield depends from a rearward portion of said hat.

9. The combination of claim 1 wherein:

at least a substantial portion of said clip member is disposed within an interior cavity of said hat;

said clip member being secured with an interior hat band that is disposed within the interior cavity of said hat.

10. A method of shielding an individual from weather related elements, the method comprising:

providing a hat, having a generally annular body with an opening defined by a peripheral edge portion;

providing a generally planar shield having a peripheral edge portion;

providing a clip member, comprising:

an engagement plate, having (i) opposite end portions; (ii) a first surface positioned to face a first direction; and (iii) a second surface positioned to past in a second direction that is generally opposite the first direction;

a first clip arm, pivotably coupled with one end portion of said engagement plate so that the first clip arm may be selectively moved between a closed position, whereby a free end portion of said first clip arm is positioned closely adjacent the first surface of said engagement plate, and an open position, whereby the free end portion of said first clip arm is positioned is a spaced-apart relationship with the first surface of aid engagement plate;

a second clip arm, pivotably coupled with one end portion of said engagement plate so that the second clip arm may be selectively moved between a closed position, whereby a free end portion of said second clip arm is positioned closely adjacent the second surface of said engagement plate, and an open position, whereby the free end portion of said second clip arm is positioned in a spaced-apart relationship with the second surface of said engagement plate;

securing a portion of the peripheral edge portion of said shield between the first clip arm and the first surface of the engagement plate of said clip member;

securing a portion of the peripheral edge portion of said hat between the second clip arm and the second surface of the engagement plate of said clip member; resulting in an overlap of the shield and hat, with the top edge of the shield being situated higher than the lower edge of the hat, whereby no gap is remaining between those two edge surfaces; and positioning the bat on a portion of the individual's head in a manner that permits the shield to depend from the hat.

11. The method of claim 10 wherein:

said shield is positioned so that a length of said shield depends from a rearward portion of said hat.

12. The method of claim 10 wherein:

said shield is positioned so that a length of said shield depends from a side portion of said hat.

13. The method of claim 10 wherein:

at least a substantial portion of said clip member is disposed within an interior cavity of said hat;

said clip member being secured with an interior hat band this is disposed within the interior cavity of said hat.

14. The method of claim 10 wherein;

said shield is provided to include a material that is comprised of a generally flexible fabric.

* * * * *